US008727315B2

(12) United States Patent
Ringgenberg

(10) Patent No.: US 8,727,315 B2
(45) Date of Patent: May 20, 2014

(54) BALL VALVE

(75) Inventor: Paul David Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 233 days.

(21) Appl. No.: 13/117,905

(22) Filed: May 27, 2011

(65) Prior Publication Data

US 2012/0298901 A1 Nov. 29, 2012

(51) Int. Cl.

| | |
|---|---|
| ***F16K 5/00*** | (2006.01) |
| ***F16K 5/06*** | (2006.01) |
| ***E21B 33/00*** | (2006.01) |
| ***E21B 34/00*** | (2006.01) |
| ***E21B 43/00*** | (2006.01) |
| ***E21B 34/06*** | (2006.01) |

(52) U.S. Cl.

USPC ..... 251/315.07; 251/314; 166/332.3; 166/373

(58) Field of Classification Search

USPC ..... 251/315.07, 314, 176, 180, 185, 192, 251/315.13; 166/332.3, 334.2, 373, 374, 166/375

See application file for complete search history.

(56) References Cited

U.S. PATENT DOCUMENTS

| | | | | |
|---|---|---|---|---|
| RE29,471 | E * | 11/1977 | Giroux | 166/334 |
| 4,212,355 | A * | 7/1980 | Reardon | 166/336 |
| 4,361,188 | A | 11/1982 | Russell | |
| 4,444,267 | A | 4/1984 | Beck | |
| 4,446,922 | A | 5/1984 | Bowyer et al. | |
| 4,480,659 | A | 11/1984 | Peacock | |
| 4,524,946 | A | 6/1985 | Thompson | |
| 4,596,294 | A | 6/1986 | Russell | |
| 4,633,952 | A | 1/1987 | Ringgenberg | |
| 4,650,001 | A | 3/1987 | Ringgenberg | |
| 4,655,288 | A | 4/1987 | Burris, II et al. | |
| 4,657,082 | A | 4/1987 | Ringgenberg | |
| 4,657,083 | A | 4/1987 | Ringgenberg | |

(Continued)

OTHER PUBLICATIONS

Notification of Transmittal of the International Search Report and the Written Opinion of the International Searching Authority, or Declaration (2 pages); International Search Report (3 pages); and Written Opinion of the International Searching Authority (4 pages), mailed Dec. 6, 2012, for related international application PCT/US2012/037417.

(Continued)

*Primary Examiner* — John K Fristoe, Jr.
*Assistant Examiner* — Michael R Reid
(74) *Attorney, Agent, or Firm* — Fish & Richardson P.C.; Joshua A. Griswold; Bradley A. Misley

(57) ABSTRACT

A ball valve includes a first ball clamping assembly that defines a first seat surface in contact with an exterior of the ball. A second ball clamping assembly defines a second, sealing seat surface in contact with and adapted to seal with the exterior of the ball. The second ball clamping assembly is coupled to the first ball clamping assembly to clamp the ball between the first and second seat surfaces. The second ball clamping assembly includes a seat ring holder and a seat ring carried by the seat ring holder. The seat ring of the second ball clamping assembly has a sealing seat surface. A springing member is provided between the seat ring and the seat ring holder and springingly biases the seat ring toward the ball. The seat ring holder has a shoulder that supports the seat ring against fully compressing the springing member.

20 Claims, 3 Drawing Sheets

(56) References Cited

U.S. PATENT DOCUMENTS

| | | | |
|---|---|---|---|
| 4,667,743 | A | 5/1987 | Ringgenberg et al. |
| 4,694,903 | A | 9/1987 | Ringgenberg |
| 4,711,305 | A | 12/1987 | Ringgenberg |
| 4,738,431 | A | 4/1988 | Perkins |
| 4,753,292 | A | 6/1988 | Ringgenberg et al. |
| 4,817,723 | A | 4/1989 | Ringgenberg |
| 4,940,208 | A | 7/1990 | Kemp |
| 5,180,007 | A | 1/1993 | Manke et al. |
| 5,180,015 | A | 1/1993 | Ringgenberg et al. |
| 5,269,347 | A | 12/1993 | Beasley |
| 5,320,327 | A | 6/1994 | Beson |
| 5,335,731 | A | 8/1994 | Ringgenberg et al. |
| 5,341,883 | A | 8/1994 | Ringgenberg |
| 5,411,097 | A | 5/1995 | Manke et al. |
| 5,518,073 | A | 5/1996 | Manke et al. |
| 5,540,280 | A | 7/1996 | Schultz et al. |
| 5,551,665 | A | 9/1996 | Noack et al. |
| 5,555,945 | A | 9/1996 | Schultz et al. |
| 5,558,162 | A | 9/1996 | Manke et al. |
| 5,597,016 | A | 1/1997 | Manke et al. |
| 5,603,482 | A | 2/1997 | Mott et al. |
| 5,649,597 | A | 7/1997 | Ringgenberg |
| 5,791,414 | A | 8/1998 | Skinner et al. |
| 5,799,733 | A | 9/1998 | Ringgenberg et al. |
| 5,890,542 | A | 4/1999 | Ringgenberg |
| 6,065,736 | A | 5/2000 | Hunt |
| 6,236,620 | B1 | 5/2001 | Schultz et al. |
| 6,325,146 | B1 | 12/2001 | Ringgenberg et al. |
| 6,435,282 | B1 | 8/2002 | Robison et al. |
| 6,446,719 | B2 | 9/2002 | Ringgenberg et al. |
| 6,446,720 | B1 | 9/2002 | Ringgenberg et al. |
| 6,527,052 | B2 | 3/2003 | Ringgenberg et al. |
| 6,708,946 | B1 | 3/2004 | Edwards et al. |
| 6,729,398 | B2 | 5/2004 | Ringgenberg et al. |
| 6,966,386 | B2 | 11/2005 | Ringgenberg et al. |
| 7,021,375 | B2 | 4/2006 | Ringgenberg et al. |
| 7,048,066 | B2 | 5/2006 | Ringgenberg et al. |
| 7,073,579 | B2 | 7/2006 | Ringgenberg et al. |
| 7,086,463 | B2 | 8/2006 | Ringgenberg et al. |
| 7,093,674 | B2 | 8/2006 | Paluch et al. |
| 7,096,976 | B2 | 8/2006 | Paluch et al. |
| 7,201,230 | B2 | 4/2007 | Schultz et al. |
| 7,325,597 | B2 | 2/2008 | Ringgenberg et al. |
| 7,594,763 | B2 | 9/2009 | Richards et al. |
| 7,730,954 | B2 | 6/2010 | Schultz et al. |
| 7,758,016 | B2 | 7/2010 | Scott et al. |
| 7,926,575 | B2 | 4/2011 | Ringgenberg et al. |
| 2001/0045285 | A1 | 11/2001 | Russell |
| 2007/0252102 | A1 | 11/2007 | Kemp |
| 2008/0179558 | A1 * | 7/2008 | Lloyd ..... 251/180 |
| 2010/0243259 | A1 | 9/2010 | Wright et al. |

OTHER PUBLICATIONS

Authorized Officer Philippe Becamel, International Preliminary Report on Patentability, PCT/US2012/037417, Dec. 12, 2013, 6 pages.

* cited by examiner

BALL VALVE

BACKGROUND

A ball valve is a type of valve that uses a spherical ball as a closure mechanism. The ball has a bore therethrough that is aligned with the direction of flow when the valve is open and misaligned with the direction of flow when the valve is closed. Ball valves have many applications in well tools for use downhole in a wellbore, for example, as formation tester valves, safety valves, and in other downhole applications. Many of these well tool applications use a ball valve because ball valves can have a large through bore for passage of tools, tubing strings, and flow, yet also be compactly arranged, for example, having a cylindrical outer profile that corresponds to the cylindrical outer profile of the remainder of the string carrying the ball valve into the well bore and presenting few or no protrusions to hang up on the interior of the well.

SUMMARY

This disclosure describes a well tool ball valve.

Certain aspects encompass a ball valve having a ball with a flow bore therethrough. A first ball clamping assembly defines a first seat surface in contact with an exterior of the ball. A second ball clamping assembly defines a second, sealing seat surface in contact with and adapted to seal with the exterior of the ball. The second ball clamping assembly is coupled to the first ball clamping assembly to clamp the ball between the first and second seat surfaces. The second ball clamping assembly includes a seat ring holder and a seat ring carried by the seat ring holder. The seat ring of the second ball clamping assembly has a sealing seat surface. A springing member is provided between the seat ring and the seat ring holder and springingly biases the seat ring toward the ball. The seat ring holder has a shoulder that supports the seat ring against fully compressing the springing member.

Certain aspects encompass a wellbore ball valve having a ball with a flow bore therethrough, and a first ball clamping assembly defining a generally cylindrical shape and having a first seat surface in contact with an exterior of the ball. A second ball clamping assembly defines a generally cylindrical shape and has a second seat surface in contact with and substantially sealing with the exterior of the ball. The second ball clamping assembly is adjustably coupled to the first ball clamping assembly to clamp the ball between the first and second seat surfaces. If the ball were not present, the first and second ball clamping assemblies are adjustable to allow a greatest distance between the first and second seat surfaces to be adjusted to be smaller than a diameter of the ball.

Certain aspects encompass a method, where a first portion of a well tool ball valve and a second portion of the valve are adjusted relatively toward one another to contact a seat surface of the first portion and a seat surface on a seat ring of the second portion to a ball of the valve. In adjusting the first and second portions, a resilient member supporting the seat ring is compressed until the seat ring contacts a shoulder. The first portion of the valve and the second portion of the valve are then adjusted relatively away from one another until the resilient member supports the seat ring out of contact with the shoulder.

The details of one or more embodiments are set forth in the accompanying drawings and the description below. Other features, objects, and advantages will be apparent from the description and drawings, and from the claims.

DESCRIPTION OF DRAWINGS

FIG. 2A shows the ball valve closed, FIG. 2B shows the ball valve open, and FIG. 2C shows a zoomed image of a portion of FIG. 2A.

Like reference symbols in the various drawings indicate like elements.

DETAILED DESCRIPTION

Figure 1:
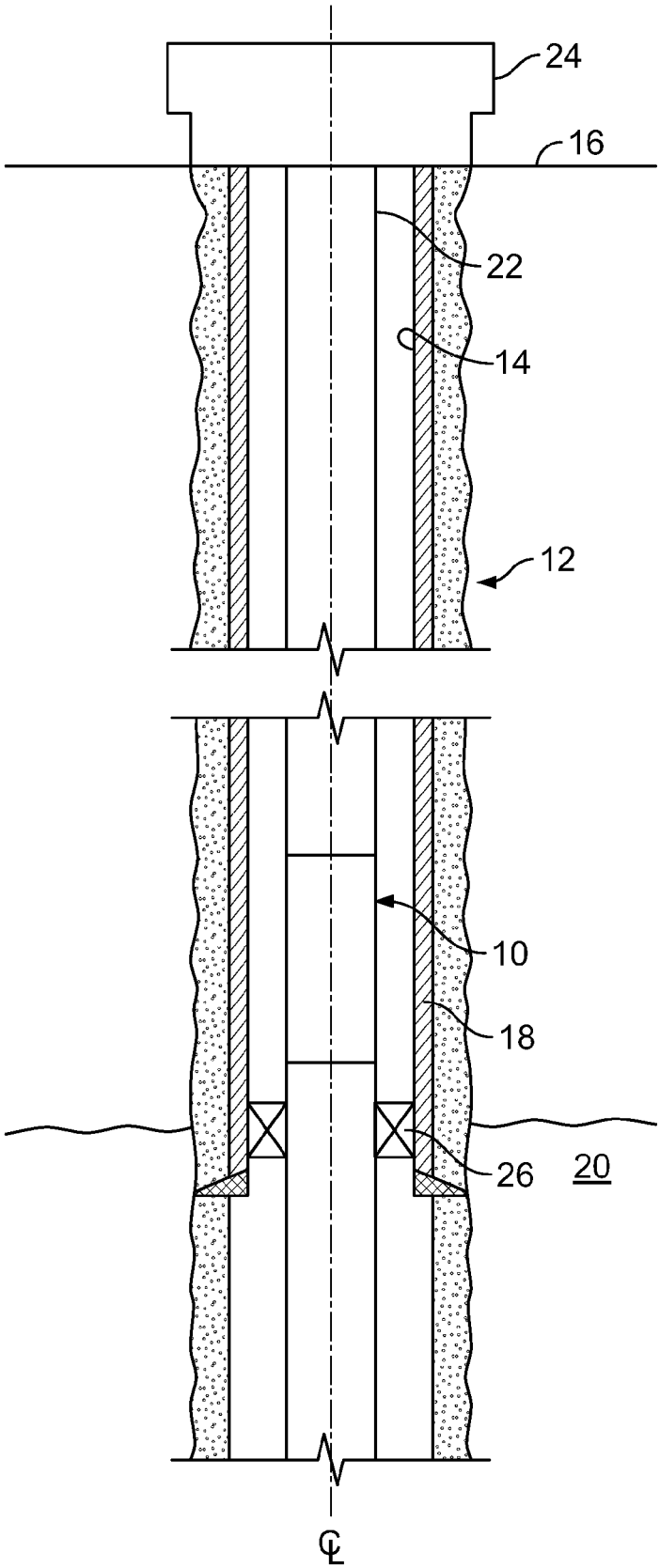
FIG. 1 is a schematic side view of an example ball valve in a well system.

Referring first to FIG. 1, an example well tool ball valve 10 constructed in accordance with the concepts described herein is shown in a well system 12. The well system 12 includes a well bore 14 that extends from a terranean surface 16 into one or more subterranean zones 20, and when completed, the well system 12 produces reservoir fluids and/or injects fluids into the zones. In certain instances, the well bore 14 is lined with casing or liner 18. The example ball valve 10 is shown in a tubing string 22 that extends from a wellhead 24 of the well system 10. The ball valve 10 is in a generally cylindrical configuration, of a diameter approximately equal to the diameter of the remainder of the tubing string 22 and without elements that protrude radially outward, so that the ball valve 10 can pass smoothly (i.e., without hanging up) through a cylindrical wellbore. The tubing string 22 may be a coiled tubing and/or a string of jointed tubing coupled end to end. In certain instances, the tubing string 22 may be a drill string, a working string, and/or a production/injection string. For example, the ball valve 10 may be used in the context of drill stem testing. In drill stem testing, the tubing string 22 is a drill string constructed of drill pipe or other working string and is sealed to the casing 18 with a packer 26 to isolate the subterranean zone below the packer 26. Thereafter, the subterranean zone below the packer 26 can be pressurized or depressurized and the pressure behavior of the subterranean zone observed. Other example contexts in which the ball valve 10 can be used include formation sampling, as a safety valve and/or other operations.

Figure 2A:
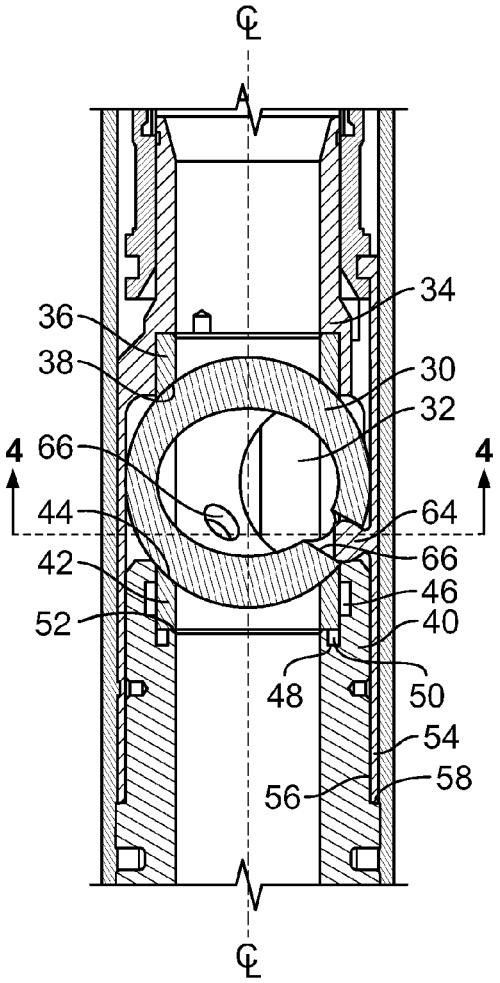
FIGS. 2A, 2B, and 2C are detailed side cross-sectional views of the example ball valve, where
Figure 2B:
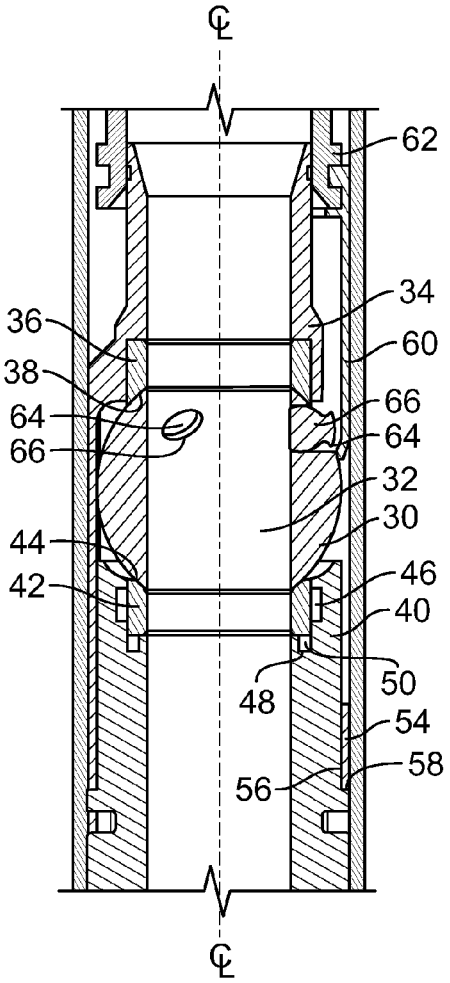
Figure 2C:
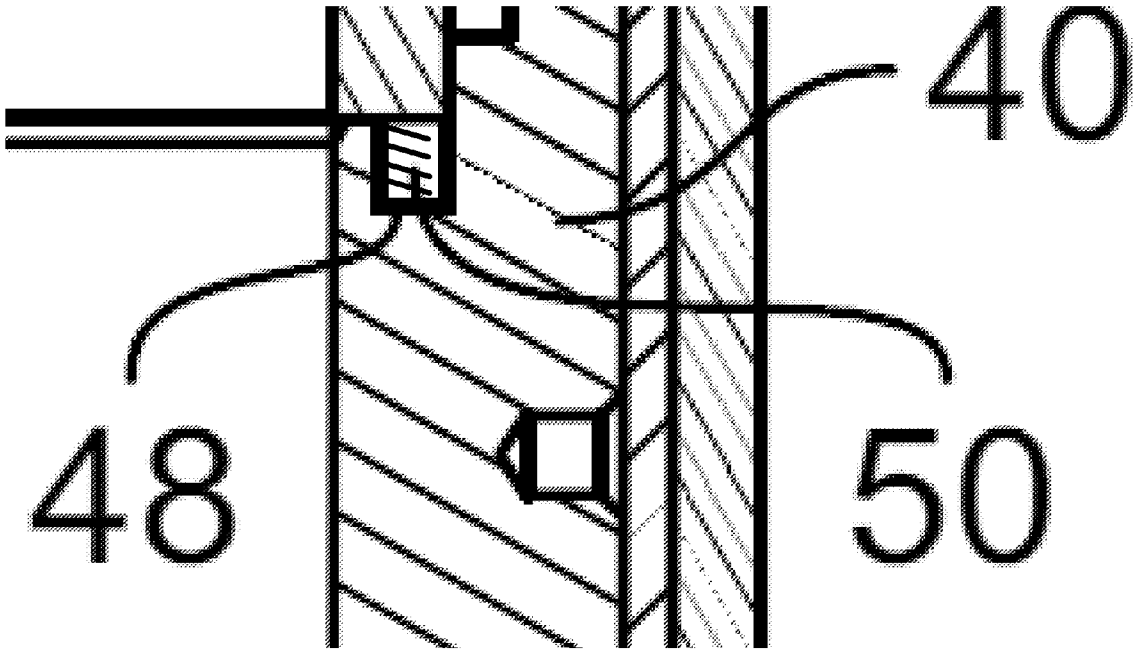

Referring now to FIGS. 2A, 2B, and 2C, the example well tool ball valve 10 is shown in side cross section (and in a zoomed image in FIG. 2C). The ball valve 10 has a cylindrical central flow bore 11 that runs axially through the valve 10. The central flow bore 11 is adapted to circumferentially align with and communicate fluid with a central flow bore of the remainder of the string in which the ball valve 10 will be installed. The ball valve 10 has a substantially spherical ball 30 that has its own a cylindrical central flow bore 32 therethrough. When the valve 10 is open, the central flow bore 32 is a part of the central flow bore 11, and is circumferentially aligned with and communicates fluids with the remainder of the central flow bore 11.

The ball 30 is clamped between two clamping assemblies. One clamping assembly includes a generally cylindrical ball cage 34 that carries a seat ring 36. The seat ring 36 has a seat surface 38 in contact with a spherical exterior surface of the ball 30. The second clamping assembly includes a generally cylindrical seat ring holder 40 that carries a second, sealing seat ring 42 having a sealing seat surface 44 in contact with the spherical exterior surface of the ball 30. The tubular ball cage 34 includes a cage portion that extends around the ball 30 and threadingly engages to the seat ring holder 40 to clamp the seat rings 36, 42 to and hold the seat surfaces 38, 44 in contact with the exterior surface of the ball 30. The ball 30 and other components are metal. The sealing seat ring 42, although metal, is to some degree more compliant than the material of the ball 30 to enable a metal-to-metal liquid tight (substantially or entirely liquid tight), and in certain instances gas tight (substantially or entirely gas tight), seal against the exterior surface of the ball 30. The outer diameter of the sealing seat ring 42 is also sealed (substantially or entirely) to an inner diameter of the seat ring holder 40 with a seal 46 (e.g., o-ring and/or other seal). This seal and the metal-to-metal seal between the sealing seat ring 42 and the exterior of the ball 30 seal against passage of fluid past the exterior of the ball 30.

The seat ring holder 40 defines an annular pocket 48 that is open towards the sealing seat ring 42. The pocket 48 contains a springing member 50 (shown in the zoomed image of FIG. 2C) that reacts against the sealing seat ring 38 and the base of the pocket 48 to springingly bias the sealing seat ring 38 into the ball 30. The springing member 50 maintains the sealing seat ring 38 in contact with the ball 30 over thermal expansion/contraction and flexure of the various components. In certain instances, the springing member 50 is one or more annular springs (e.g., wave spring, Bellville spring, coil spring, polymer ring and/or other spring). The seat ring holder 40 adjacent the pocket 48 has a shoulder 52 that faces the sealing seat ring 42 and protects the springing member 50. The depth of the pocket 48, measured axially from this shoulder 52 to the base of the pocket 48, is less than the free, uncompressed height of the springing member 50 and greater than the set height of the springing member 50, i.e., the compressed height at which the springing member 30 plastically deforms. Therefore, the sealing seat ring 42 will abut and rest on the shoulder 52, rather than over compress, and over stress, the springing member 50.

Mating threads of the ball cage 34 and seat ring holder 40 are configured to allow the ball cage 34 and seat ring holder 40 to adjustably couple together, so that the distance between the seating surface 38 and the base of the pocket 30 against which the springing member 50 reacts can be adjusted. The adjustable coupling between the ball cage 34 and seat ring holder 40 enables adjusting how tightly the ball 30 is clamped, or in corollary, how compressed the springing member 50 is when the ball 30 is clamped between the seating surfaces 38,44. In certain instances, the threads enable the ball cage 34 and seat ring holder 40 to over-clamp, that is, the mating threads can be configured to allow the ball cage 34 and seat ring holder 40 to couple with a largest distance between the seating surface 38 and seating surface 44, when the sealing seat ring 42 is resting on the shoulder 52 and the ball 30 absent, being smaller than the outer diameter of the ball 30. For example, as shown in FIG. 2B, the seat ring holder 40 has male threads 54 on its exterior that mate with and are internally received in female threads 56 on the interior of the ball cage 34. When the ball cage 34 is fully threaded onto the seat ring holder 40, the ball cage 34 abuts a thread end shoulder 58 on the seat ring holder 40. The shoulder 58 is positioned and enough threads are provided to enable the ball cage 34 and seat ring holder 40 to over-clamp. Also, the thread end shoulder 58 and springing member protecting shoulder 52 are relatively positioned so that, with the ball 30 between the seat rings 36, 42, the sealing seat ring 42 abuts the springing member protecting shoulder 52 before the ball cage 34 abuts the thread end shoulder 58. In other words, the shoulder 52 defines a positive stop that protects the springing member 50.

When the ball cage 34 and seat ring holder 40 are assembled to clamp the ball 30, the ball cage 34 can be threaded onto the seat ring holder 40 until the sealing seat ring 42 abuts the springing member protecting shoulder 52 (without the ball cage 34 abutting the thread end shoulder 58) and then backed off (i.e., loosened) to move the sealing seat ring 42 out of contact with the springing member protecting shoulder 52 and achieve the desired amount of compression in the springing member 50 and clamping of the ball 30 by the seating surfaces 38, 44. The resulting gap between the sealing seat ring 42 and springing member protecting shoulder 52 need not be large, and if small, the springing member 50 only has to compensate for the small amount of movement. For example, in certain instances, the gap can be approximately 0.01 inch (0.25 mm). The relative position of the ball cage 34 and seat ring holder 40 can be fixed with a set screw engaging both the cage and holder and/or in another manner. The compression of the springing member 50 is thus adjustable by adjusting how deeply the seat ring holder 40 is received in the ball cage 34 and not, for example, by the relative position of the springing member protecting shoulder 52 and the thread end shoulder 58. Thus, the relational tolerance between the springing member protecting shoulder 52 and the thread end shoulder 58 need not be a closely held tolerance, as long as the sealing seat ring 42 can abut the shoulder 52 before the ball cage 34 abuts the thread end should 58.

Notably, although the coupling of the ball cage 34 and seat ring holder 40 have been described above as coupling with threads, other manners of coupling could be used. Furthermore, the male and female portions of the threads or other coupling could be reversed, with the male portion on the ball cage 34 and the female portion on the seat ring holder 40.

FIG. 2A shows the ball 30 in a closed position with the flow bore 32 misaligned with the remainder of flow bore 11, and the opening to the flow bore 32 positioned so that no portion thereof coincides with the inner bore of the sealing seat ring 42. In the closed position, the ball valve 10 seals against passage of fluids through the flow bore 11 of the ball valve 10 and through the tubing string. The springing member 50 constantly applies pressure to the sealing seat ring 42, biasing the seating surfaces 38, 44 into the exterior of the ball 30 and maintaining an initial seal between the sealing seat surface 44 of the sealing seat ring 42 and the exterior of the ball 30. The initial bias applied by the springing member 50 tends to ensure a seal between the sealing seat ring 42 and the ball 30, even at low pressure differentials. When higher pressure is applied from the sealing seat ring 42 side than from the seat ring 36 side, the pressure acts on sealing seat ring 42 further biasing it to seal against the exterior of the ball 30. When higher pressure is applied from the seat ring 36 side than from the sealing seat ring 42 side, the ball 30 tends to shift toward the seat ring holder 40 to shoulder the sealing seat ring 42 against the springing member protecting shoulder 52. The springing member protecting shoulder 52, thus, prevents the springing member 50 from over compressing and over stressing.

FIG. 2B shows the ball 30 in a fully open position with the flow bore 32 is aligned with the remainder of the flow bore 11, including the respective bores the ball cage 34 and seat ring holder 40, as well as the remainder of the tubing string. In the open position, the ball valve 10 allows flow through the ball valve 10 and through the tubing string.

Figure 3:
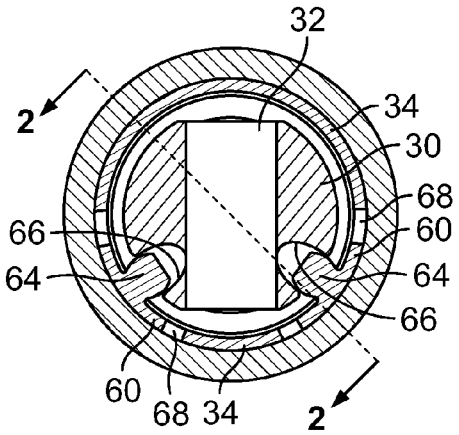
FIG. 3 is an axial cross-sectional view taken along line 3-3 in FIG. 2A.

The ball 30 is changed between the closed and full open position by axially shifting a ball operating assembly. The ball operating assembly includes a plurality of ball arms 60 that are coupled to the ball 30 and carried to move in unison by an annular ball arm connector 62. The ball arms 60 (two shown, but fewer or more could be used) each include a knuckle 64 that is received in a receptacle 66 in the exterior of the ball 30. As best seen in FIG. 3, the receptacles 66 are arranged on one side of the ball 30 and on either side of the flow bore 32. The ball arm connector 62 is received over and sealed to the ball cage 34 to shift axially relative to the ball cage 34. The ball arms 60 reside in elongate axial openings 68 in the cage 34. When the ball arm connector 62 is shifted axially from the position in FIG. 2A to the position in FIG. 2B (toward downhole in the illustrated configuration) the ball arms 60 roll the ball 30 to the fully open position. When ball arm connector 62 is shifted axially from the position in FIG. 2B to the position in FIG. 2A (toward uphole in the illustrated configuration) the ball arms 60 roll the ball 30 to the closed position.

A number of embodiments have been described. Nevertheless, it will be understood that various modifications may be made. Accordingly, other embodiments are within the scope of the following claims.

What is claimed is:

1. A wellbore ball valve, comprising:

a ball having a flow bore therethrough;

a first ball clamping assembly defining a first seat surface in contact with an exterior of the ball;

a second ball clamping assembly defining a second, sealing seat surface in contact with and adapted to seal with the exterior of the ball, the second ball clamping assembly coupled to the first ball clamping assembly to clamp the ball between the first and second seat surfaces, the first ball clamping assembly adjustably coupled to the second ball clamping assembly, the second ball clamping assembly comprising:

a seat ring holder;

a seat ring carried by the seat ring holder and comprising the second, sealing seat surface; and a springing member between the seat ring and the seat ring holder springingly biasing the seat ring toward the ball, the seat ring holder having a shoulder that supports the seat ring against fully compressing the springing member, and a compression of the springing member is adjustable based on the adjustable coupling of the first ball clamping assembly to the second ball clamping assembly.

2. The ball valve of claim 1, wherein a distance between the first seat surface and the shoulder is adjustable based on the adjustable coupling of the first ball clamping assembly to the second ball clamping assembly.

3. The ball valve of claim 2, wherein, if the ball were not present, the first and second ball clamping assemblies can be adjusted so that a greatest distance between the first seat surface and the second seat surface, when the seat ring is resting on the shoulder, is less than a diameter of the ball.

4. The ball valve of claim 1, wherein the first and second ball clamping assemblies are coupled by mating threads on the ball clamping assemblies and more threads are provided than are needed to clamp the ball between the first and second seat surfaces with the seat ring abutting the shoulder.

5. The ball valve of claim 1, wherein the first and second ball clamping assemblies are generally cylindrical and in coupling together, one is received over the other.

6. The ball valve of claim 1, wherein the first seat surface is on a first seat ring of the first ball clamping assembly.

7. The ball valve of claim 1, wherein the first and second seat surfaces contact the ball with the seat ring residing out of contact from the shoulder of the seat ring holder.

8. The ball valve of claim 1, wherein the springing member has an over stress compression at which the springing member plastically deforms and wherein the shoulder supports the seat ring against compressing the springing member to the over stress compression.

9. The ball valve of claim 1, wherein the seat ring holder defines a springing member receiving pocket having a depth that is less than a free height of the springing member and wherein the shoulder of the seat ring holder is adjacent the pocket.

10. The ball valve of claim 1, wherein the springing member comprises an annular metallic spring.

11. A wellbore ball valve, comprising:

a ball having a flow bore therethrough;

a first ball clamping assembly defining a generally cylindrical shape and having a first seat surface in contact with an exterior of the ball;

a second ball clamping assembly defining a generally cylindrical shape and having a second seat surface in contact with and substantially sealing with the exterior of the ball, the second ball clamping assembly adjustably coupled to the first ball clamping assembly to clamp the ball between the first and second seat surfaces and, if the ball were not present, to allow a greatest distance between the first and second seat surfaces to be adjusted to be smaller than a diameter of the ball; and a springing member springingly biasing the first and second seat surfaces against the exterior of the ball such that a compression of the springing member is adjustable based on the adjustable coupling of the first ball clamping assembly to the second ball clamping assembly.

12. The ball valve of claim 11, wherein the first and second ball clamping assemblies are coupled by mating threads on the ball clamping assemblies and more threads are provided than are needed to clamp the ball between the first and second seat surfaces.

13. The wellbore ball valve of claim 11, wherein the second ball clamping assembly comprises:

a seat ring holder;

a seat ring carried by the seat ring holder and comprising the second seat surface, wherein the springing member is positioned between the seat ring and the seat ring holder and springingly biases the seat ring toward the ball, the seat ring holder having a shoulder that supports the seat ring against fully compressing the springing member.

14. The ball valve of claim 13, wherein the springing member has an over stress compression at which the springing member plastically deforms and wherein the shoulder supports the seat ring against compressing the springing member to the over stress compression.

15. The ball valve of claim 14, wherein the springing member comprises an annular metallic compression spring.

16. The ball valve of claim 13, wherein the seat ring holder defines a springing member receiving pocket having a depth that is less than a free height of the springing member and wherein the shoulder of the seat ring holder is adjacent the pocket.

17. A method, comprising:

adjusting a first portion of a well tool ball valve and a second portion of the well tool ball valve relatively toward one another, an adjustable distance, to contact a seat surface of the first portion and a seat surface on a seat ring of the second portion to a ball of the valve;

compressing a resilient member that supports the seat ring the adiustable distance that is less than a compressive length of the resilient member until the seat ring contacts a shoulder; and adjusting the first portion of the valve and the second portion of the valve relatively away from one another until the resilient member supports the seat ring out of contact with the shoulder.

18. The method of claim 17, wherein the resilient member has an over stress compression at which the resilient member plastically deforms and wherein compressing the resilient member until the seat ring contacts the shoulder comprises compressing the resilient member less than the over stress compression of the resilient member.

19. The method of claim 17, comprising sealing against fluid flow between the ball valve and the seat surface of the second portion.

20. The method of claim 19, where adjusting the first portion and the second portion relatively toward one another comprises engaging threads of the first portion with threads of the second portion and screwing threads into deeper engagement.

* * * * *

UNITED STATES PATENT AND TRADEMARK OFFICE

CERTIFICATE OF CORRECTION

PATENT NO. : 8,727,315 B2
APPLICATION NO. : 13/117905
DATED : May 20, 2014
INVENTOR(S) : Paul David Ringgenberg It is certified that error appears in the above-identified patent and that said Letters Patent is hereby corrected as shown below:

In the Claims

In Column 6, Line 59, Claim 17, replace "adiustable" with -- adjustable --

Signed and Sealed this
Twelfth Day of August, 2014

Michelle K. Lee

Michelle K. Lee
*Deputy Director of the United States Patent and Trademark Office*